US005732947A

United States Patent [19]

Noack

[11] Patent Number: 5,732,947

[45] Date of Patent: Mar. 31, 1998

[54] SLIDING CHECKERBOARD

[76] Inventor: Daniel J. Noack, 14918 Quaking Aspen, Tomball, Tex. 77376

[21] Appl. No.: 784,147

[22] Filed: Jan. 17, 1997

[51] Int. Cl.[6] ..... A63F 3/02

[52] U.S. Cl. ..... 273/260; 273/261; 273/283; 273/284

[58] Field of Search ..... 273/283, 261, 273/260, 284, 287

[56] References Cited

U.S. PATENT DOCUMENTS

| | | | |
|---|---|---|---|
| D. 317,791 | 6/1991 | Britton | D21/24 |
| 571,464 | 11/1896 | Truex | 273/258 |
| 715,474 | 12/1902 | Gaylor | 273/248 |
| 1,167,394 | 1/1916 | Foster | 273/283 |
| 1,421,678 | 7/1922 | Ebert | 273/258 |
| 1,596,918 | 8/1926 | Brunner | 273/242 |
| 1,955,795 | 4/1934 | Ekbom | 273/283 |
| 3,081,088 | 3/1963 | Kast | 273/236 |
| 3,163,425 | 12/1964 | Caplan | 273/284 |
| 3,731,934 | 5/1973 | Shoptaugh | 273/284 |
| 3,804,418 | 4/1974 | Sander | 273/284 |
| 4,215,866 | 8/1980 | Shimizu | 273/275 |
| 4,234,185 | 11/1980 | Alsip | 273/243 |
| 4,813,679 | 3/1989 | Hoffman | 273/248 |

FOREIGN PATENT DOCUMENTS

| | | | |
|---|---|---|---|
| 2703918 | 10/1994 | France | 273/284 |
| 2703920 | 10/1994 | France | 273/284 |
| 1440516 | 11/1988 | U.S.S.R. | 273/237 |

OTHER PUBLICATIONS

Patent Application, Serial Number 29/047354 Daniel J. Noack, Design for Sliding Checkerboard, file Apr. 29, 1996.

*Primary Examiner*—Benjamin H. Layno
*Attorney, Agent, or Firm*—Mary J. Gaskin

[57] ABSTRACT

The invention is a gameboard consisting of movable rows of squares of two alternating colors. The surface of the gameboard has the appearance of a checkerboard, with extra squares of each side of the playing field. Each player has the option of altering the playing surface between plays by moving a row of squares upon which playing pieces rest. The gameboard results in a completely different way of playing games such as checkers and chess.

5 Claims, 4 Drawing Sheets

SLIDING CHECKERBOARD

FIELD OF THE INVENTION

The present invention relates to a gameboard which enables the players to alter the playing surface between plays by moving an entire row of squares on which playing pieces rest.

BACKGROUND OF THE INVENTION

Game players are always looking for variations of familiar games in order to whet their interest. The gameboard of present invention is a variation of the common checkerboard. The checkerboard has "extra" squares on either side of the conventional playing field. The board is designed to allow each player to slide a single row of squares (on which rest playing pieces) either from side to side, or up and down, depending on the predetermined choice of play. The movement shifts the position of the playing pieces in unexpected ways, requiring players to develop new strategies in order to defeat their opponents.

SUMMARY OF THE INVENTION

The present invention has a playing surface similar to a conventional checkerboard, wherein the gameboard is divided into a number of squares of alternating color, with additional squares on both sides, or ends, of the standard square playing surface. The squares are arranged in rows which can "slide" sideways or up and down, depending on how the board is aligned between the players. A finger hole at either end of each row aids the players in sliding the rows. Marks on the surface of the board show the boundaries of the playing field on which playing pieces must be kept. Players must use strategy to decide when to move rows of players, and how far.

The features of this gameboard may be utilized for any game which is played on a checkerboard, such as checkers or chess. The possibility of sliding a row of squares, thereby altering the playing surface, gives a new dimension of play to any game played on it.

DESCRIPTION OF THE PREFERRED EMBODIMENT

Figure 1:
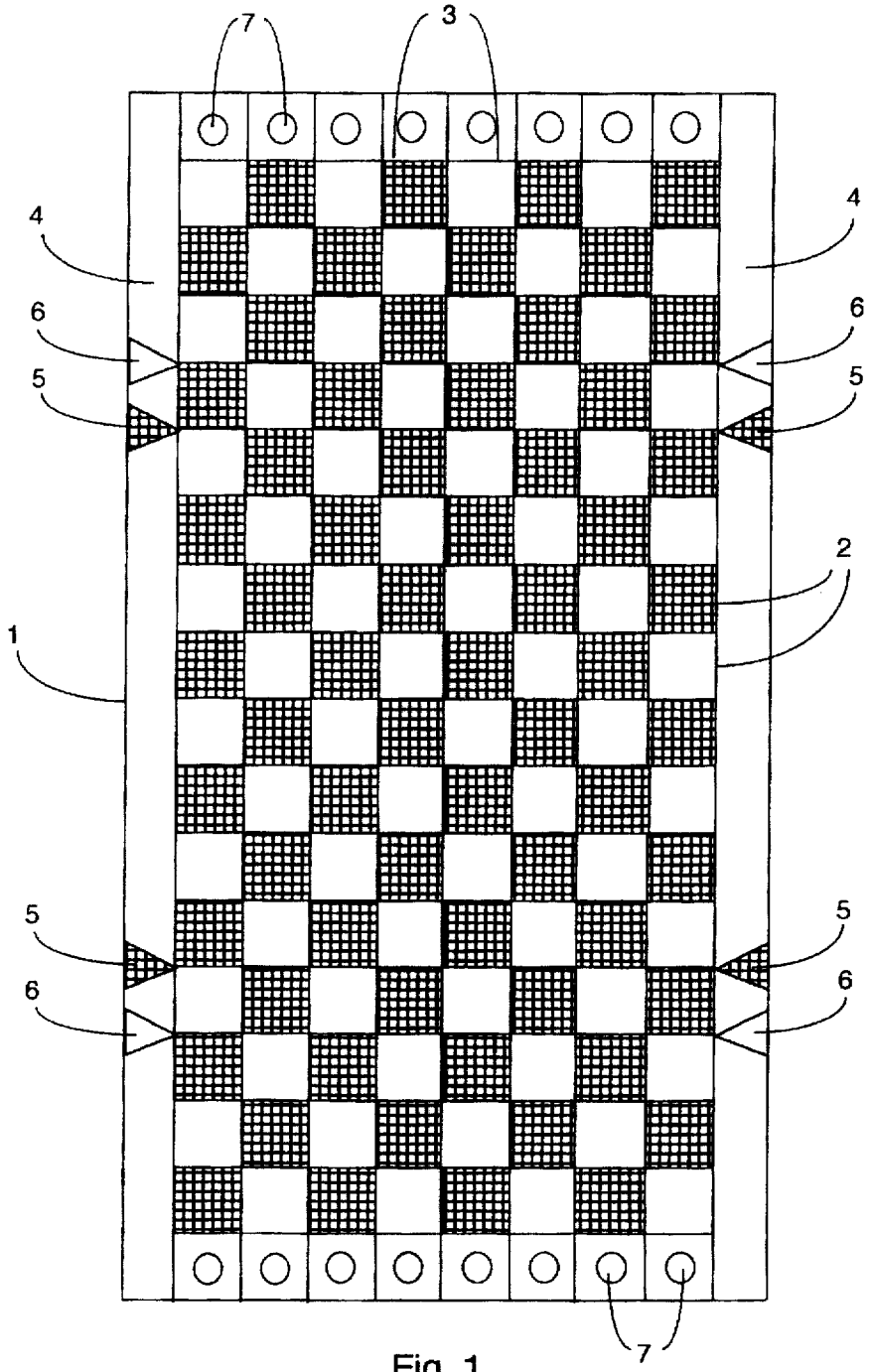
FIG. 1 is a top view of the playing surface of the gameboard.

The gameboard 1 shown in FIG. 1 is a typical embodiment of the sliding checkerboard of the present invention. The playing surface consists of 128 squares, arranged with eight squares across and sixteen squares down. The 128 squares alternate in color from white to black, across the entire surface. Each line of eight squares across is referred to as a row 2 and each line of sixteen squares down is a sliding bar 3. Two lengths of plain board 4 lie parallel to the sliding bars 3, one on each side of the checkered portion of the gameboard 1. Four black triangles 5, two painted on each plain board 4, mark the boundaries of a standard checker or chess board of 64 squares. Four white triangles 6, two painted on each plain board 4, mark the boundaries of an optional enlarged playing surface of 80 squares (8 across, and 10 down). At either end of each sliding bar 3 is a finger hole 7, which is a shallow recess or hole, which the player can use to help move each sliding bar 3 of squares.

The gameboard is preferably made of a sturdy material such as wood, but it may also be molded from plastic. The markings may be painted or stamped onto the surface. The gameboard may be constructed to lie flat, or it may be made to fold in half lengthwise, for storage purposes.

Figure 2:
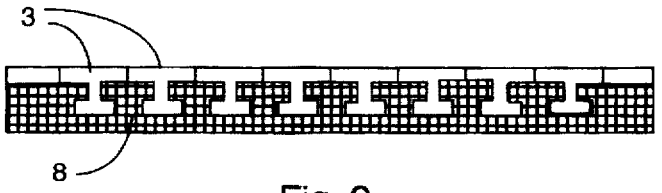
FIG. 2 is an end view of the gameboard, showing the ends of the sliding bars.

FIG. 2 shows an end view of the gameboard 1. Eight T-shaped sliding bars 3 interlock with notches in the base 8 of the gameboard 1. These eight sliding bars 3 are moveable; they can be completely detached from the base 8 of the gameboard 1, if so desired, by sliding them completely off the base 8.

The gameboard 1 may be painted colors other than those shown, and it can contain a number of squares greater or fewer than the number shown. Similarly, the boundaries within which play is confined may differ, as may the manner in which movement of the sliding bars is achieved. Changes and modifications may be made to the gameboard 1 without departing from the spirit of the invention.

Numerous games may be played on the gameboard 1. Players can use various game pieces, such as checkers or chess pieces. Players can sit opposite each other, with the board aligned either lengthwise (the bars would slide up and down) or crosswise (the bars would slide back and forth).

Figure 3:
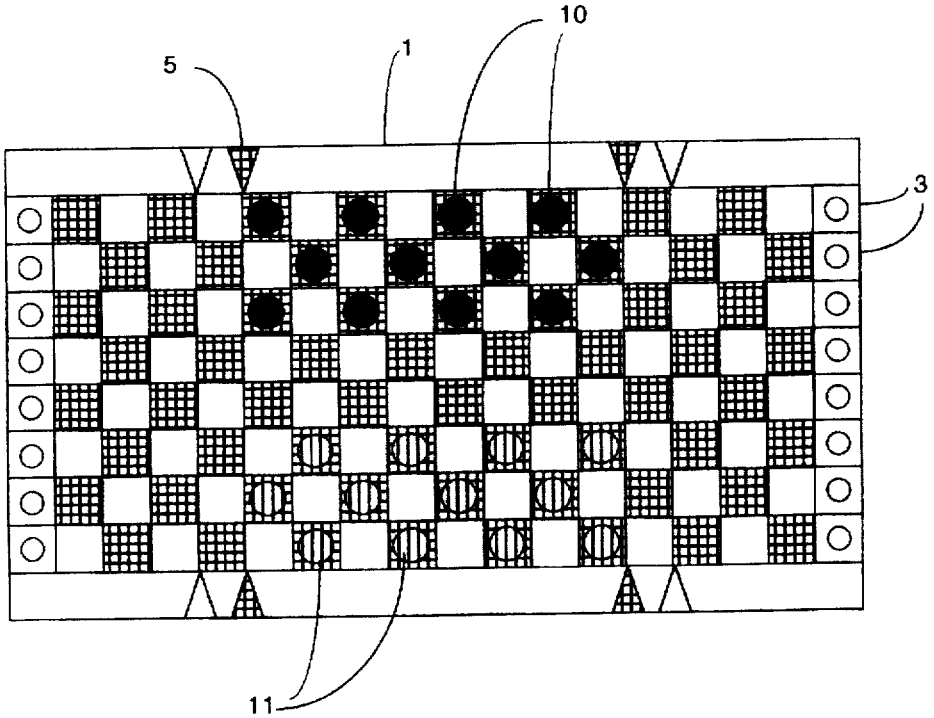
FIG. 3 is a top view of the gameboard, with playing pieces, as it would be arranged at the beginning of a game of checkers.
Figure 4:
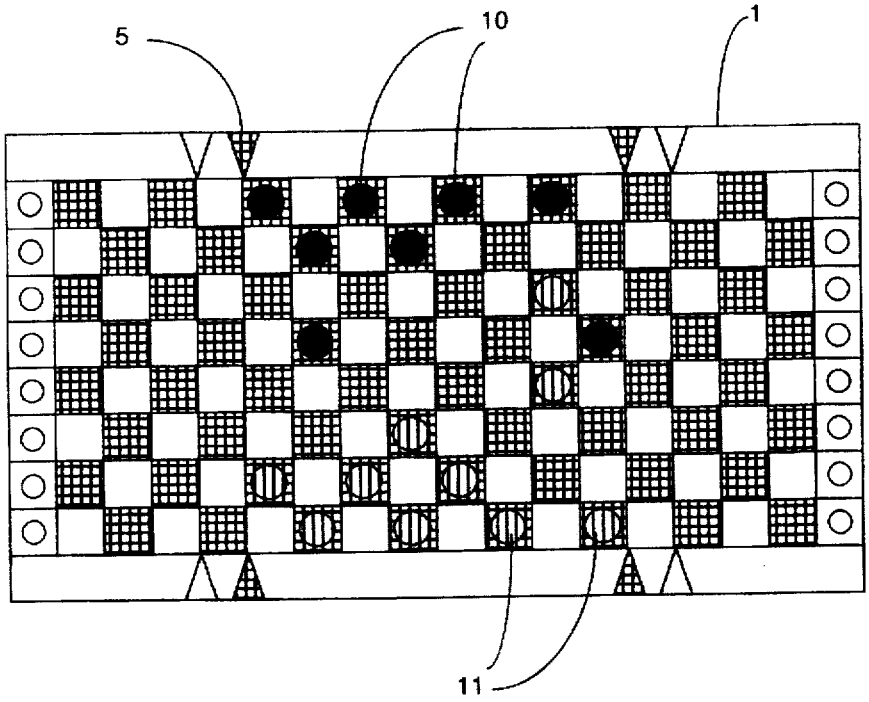
FIG. 4 is a top view of the gameboard after play has been in progress.
Figure 4A:
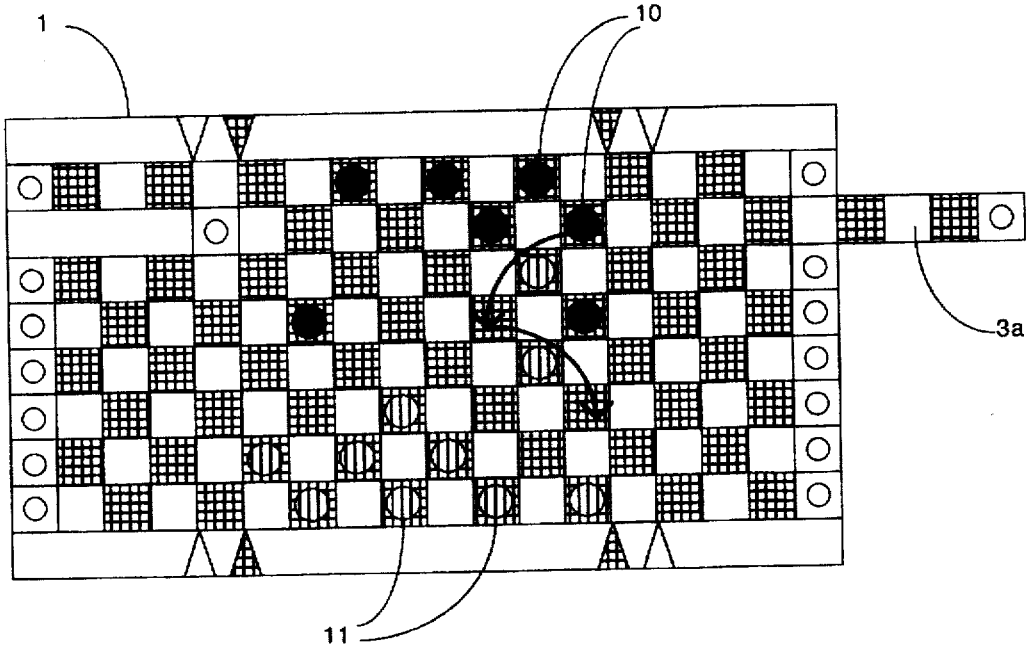
FIG. 4*a* is a top view of the gameboard showing a play after a sliding bar has been moved.
Figure 4B:
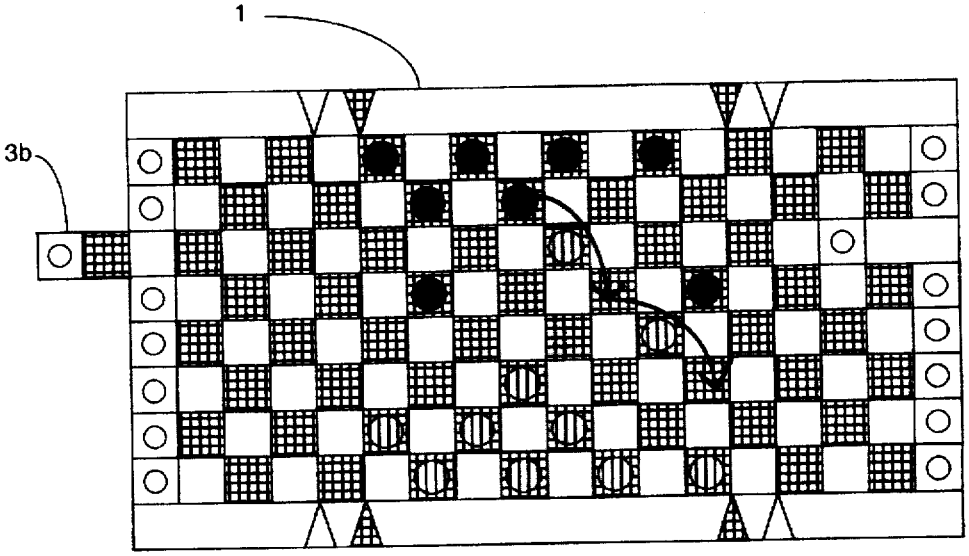
FIG. 4*b* is a top view of the gameboard showing a different play after a sliding bar has been moved in a different way.

To add a new "twist" to the game of checkers, two players would set up the gameboard 1 as shown in FIG. 3, with the typical arrangement of black checkers 10 and red checkers 11 on the black squares on opposite sides of the board. The black triangles 5 mark the corners of the playing field. Play alternates between the two players, using the same rules and moves as are used in the ordinary game of checkers. However, prior to each turn, a player has the option of moving any of the eight sliding bars 3, in either direction (left or right), as long as he does not move any game piece outside the boundaries of the playing field. As an example, FIG. 4 shows a game in progress, in which it is "Black's" turn to move. FIG. 4*a* shows the gameboard after the player has moved the sliding bar 3*a* to a new position, which then has allowed him to make a double jump (see arrows). FIG. 4*b* shows an alternative move, after the player has moved the sliding bar 3*b* to a new position to the left, which has enabled him to make a different double jump (see arrows).

Figure 5A:
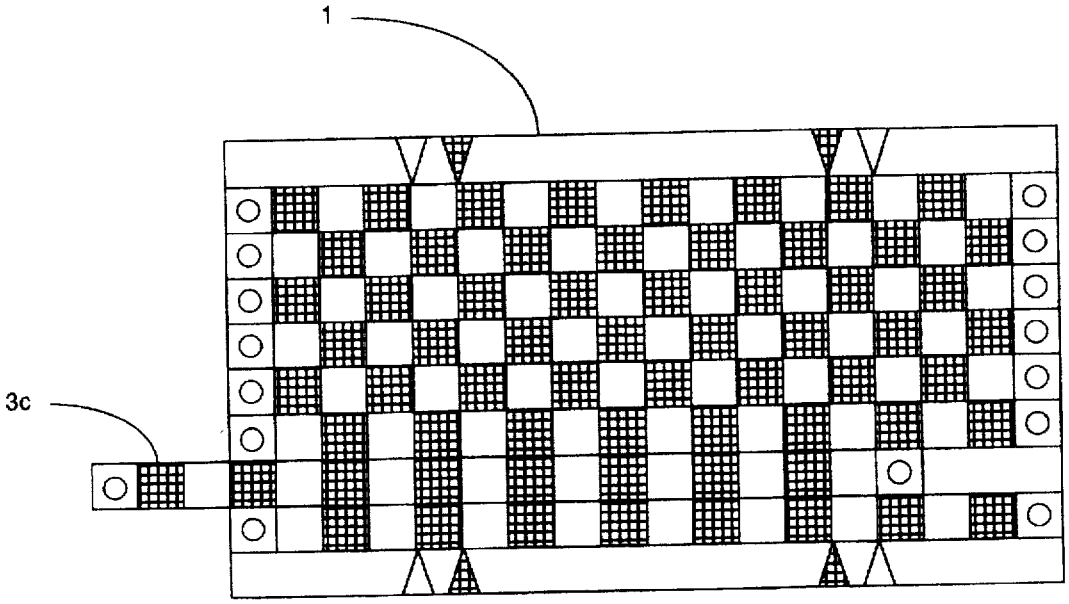
FIGS. 5*a* and 5*b* each show a top view of the gameboard with a sliding bar in an improper position.
Figure 5B:
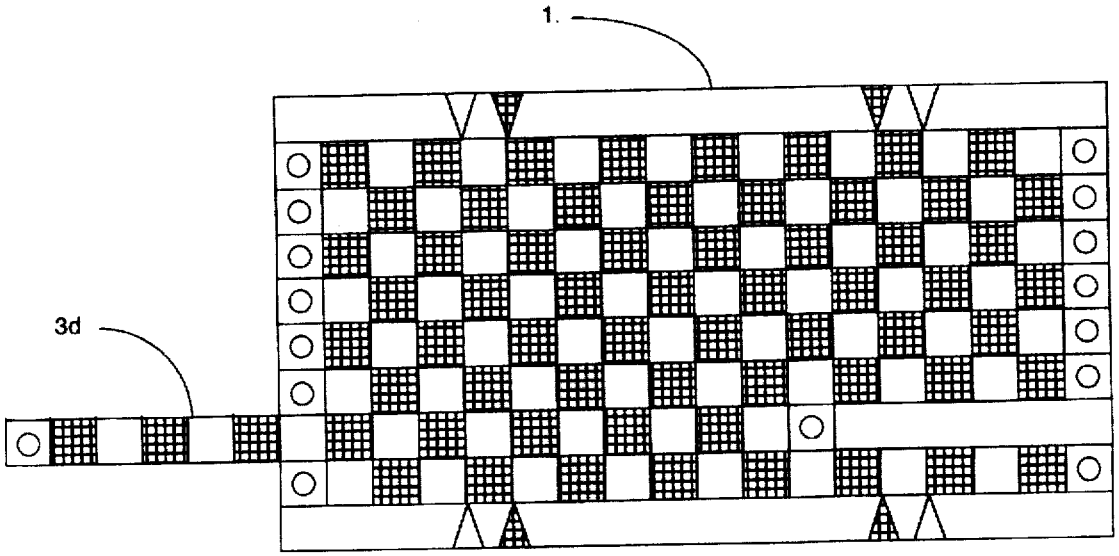

In the course of moving a sliding bar 3, a player is not permitted to move any of his or his opponent's game pieces outside the boundaries of the predetermined playing field, which is marked by either the black triangles 5 or the white triangles 6. Further, a player must not move a sliding bar 3 into a position that does not keep the checkerboard pattern intact. FIGS. 5*a* and 5*b* show improper movements of sliding bars. In FIG. 5*a*, the position of sliding bar 3*c* results in having colored squares aligned next to each other instead of alternating. In FIG. 5*b*, the sliding bar 3*d* is moved too far, so that part of the checkerboard pattern on the playing field is lost.

Many variations of the game of checkers are made possible by the movement of the sliding bars.

I claim:

1. A gameboard comprising:

a base with a plurality of notches, and a plurality of moveable bars, the top portion of each bar displaying squares of two alternating colors, said gameboard so arranged that the lower portion of each bar is moveably engaged between two of said notches, and all of said bars positioned in parallel rows such that a top surface of said gameboard has the appearance of a checkerboard, both before and after movement of said bars, said gameboard further having two unmoveable parallel rows, one disposed on each side of the total plurality of moveable parallel rows, each unmoveable parallel row having marks in multiples of two such marks designating optional boundaries for playing fields, permitting players to vary the size of each playing field before beginning play.

2. A gameboard according to claim 1 comprising eight of said moveable bars, each displaying sixteen squares of alternating colors.

3. A gameboard according to claim 1, further comprising a circular opening cut into the top portion of each end of each of said bars.

4. A game comprising a gameboard with a plurality of moveable parallel rows of squares of two alternating colors, wherein each player, prior to each turn, may move a distance of at least the width of two said squares one of said rows of squares, upon which playing pieces rest, thereby altering the position of said playing pieces with respect to playing pieces resting upon remaining rows of squares said gameboard further having two unmoveable parallel rows, one disposed on each side of the total plurality of moveable parallel rows, each unmoveable parallel row having marks in multiples of two such marks designating optional boundaries for playing fields, permitting players to vary the size of each playing field before beginning play.

5. The game according to claim 4 wherein the gameboard is comprised of eight of said moveable rows, each having sixteen squares of two alternating colors, and said unmoveable rows have marks designating optional playing surfaces of 64 squares and 80 squares.

* * * * *